US006045420A

United States Patent [19]

Small et al.

[11] Patent Number: 6,045,420

[45] Date of Patent: Apr. 4, 2000

[54] SEMI-ENCLOSED SURFACING PROPELLER DRIVER SYSTEM INCLUDING AIR INDUCTION

[76] Inventors: Mark S. Small, 5067 Garfield Rd., Delray Beach, Fla. 33484; Don R. Smith, 170 SE. 13th St., Pompano Beach, Fla. 33060

[21] Appl. No.: 09/233,505

[22] Filed: Jan. 19, 1999

[51] Int. Cl.[7] ..... B63H 5/16

[52] U.S. Cl. ..... 440/69

[58] Field of Search ..... 440/66, 69, 67, 440/68, 70, 89

[56] References Cited

U.S. PATENT DOCUMENTS

| | | |
|---|---|---|
| 965,870 | 8/1910 | Casady . |
| 1,916,597 | 7/1933 | Witte . |
| 1,966,029 | 7/1934 | Fahrney . |
| 3,702,485 | 11/1972 | Thompson . |
| 3,793,980 | 2/1974 | Sherman . |
| 3,937,173 | 2/1976 | Stuart . |
| 4,300,889 | 11/1981 | Wormser . |
| 4,371,350 | 2/1983 | Kruppa et al. . |
| 4,443,202 | 4/1984 | Arena . |
| 4,689,026 | 8/1987 | Small ..... 440/69 |
| 4,941,423 | 7/1990 | Van Tassel ..... 440/69 |
| 4,977,845 | 12/1990 | Rundquist . |
| 4,993,349 | 2/1991 | Solari . |
| 5,141,456 | 8/1992 | Langenberg et al. . |
| 5,171,175 | 12/1992 | Buzzi . |
| 5,405,278 | 4/1995 | Garland . |
| 5,482,482 | 1/1996 | Davis . |
| 5,588,886 | 12/1996 | Davis . |
| 5,667,415 | 9/1997 | Arneson . |
| 5,679,037 | 10/1997 | Rieben . |

*Primary Examiner*—Ed Swinehart
*Attorney, Agent, or Firm*—McHale & Slavin PA

[57] ABSTRACT

The instant invention is directed toward a marine craft having a semi-enclosed surfacing type propeller in a tunnel that draws air through the specific areas located and shaped to enhance performance and compensate for prime mover torque and horsepower characteristics. The invention consists of these air induction features with description of their relationship to craft performance and operating characteristics. This invention also relates certain structures and configuration of these elements, as to enhanced control of said marine craft. The control of these elements having no moving parts or operator interface. Its sequencing is established by the hull movement and the water around it.

12 Claims, 4 Drawing Sheets

SEMI-ENCLOSED SURFACING PROPELLER DRIVER SYSTEM INCLUDING AIR INDUCTION

FIELD OF THE INVENTION

The present invention relates to the field of marine water craft and more particularly to high speed power boats utilizing a surface piercing propeller drive system mounted within a propeller tunnel formed integral to the hull of the boat.

BACKGROUND OF THE INVENTION

Surface piercing drive technology and propeller tunnels are an established art which the inventor helped pioneer having been awarded U.S. Pat. No. 4,689,026, the contents of which are incorporated herein by reference. The drive systems can be highlighted by their ability to provide enhanced boat performance by use of the surface piercing propellers while safely placing such propellers beneath the hull of the water craft.

The obvious disadvantages of the surface piercing propellers may be found in reference to U.S. Pat. No. 5,667,415 issued to Arneson. The surfacing propeller is well known for its speed, as well as its lack of thrust at low speed, overloading its power source at preplane speeds and low thrust in reverse. Arneson has successfully commercialized surface piercing propellers which position a propeller near the surface of the water at a location outward from the transom of a boat. Air is drawn into and through the propellers and through the principles of compression/cavitation the propeller is able to function according to its design characteristics, thus leading to enhanced speed and performance derived from the surface piercing technology. Disadvantages to the surface piercing technology are mainly directed to the location of the propeller which is typically at the back of the boat. This interferes with the use of the back of the boat for fishing, diving or swimming and exposes the propeller to a position that is most dangerous. Representative disclosures relating to surface piercing technology can be found in U.S. Pat. Nos. 4,645,463 and 4,909,175.

Other disadvantages are the need to rotate the drives since they operate as a rudder and the inability to operate such drive systems at low speed which became the subject of the Arneson Pat. No. 5,667,415 previously mentioned. In this registration the invention discloses the use of a shroud that is placed around the propeller which prevents "walking" of the propeller at low speed but also protects individuals or marine life from impacting the propellers.

The directing of air to the propeller while it is beneath the boat provides a known benefit and is the subject of various types of prior art such as the following: U.S. Pat. Nos. 2,434,700; 3,702,485; Re.23,105; Re. 38,522; 130,391; 807,769; 815,270; 1,081,876, 1,117,357; 1,262,942; 1,401,963; 2,138,831; 3,450,090; 4,031,846; 4,363,630; 4,383,828; 22,080; 965,870, 1,916,597; 1,966,029; 3,793,980; 3,937,173; 4,300,889; 4,443,202; 5,141,456; 5,405,278; 5,171,175; 5,667,415; 5,679,037; 4,977,845; 4,371,350; 4,993,349; 5,482,482; 5,588,886; and 4,941,423.

What is lacking in the art is the teaching of a surface technology that forms air passageways that enhance surface piercing propeller operation at low speed, during acceleration, and under rough sea conditions.

SUMMARY OF THE INVENTION

The present invention is directed to marine vessels having a surface piercing propeller(s) in a defined enclosure. The configurations define an air induction system that allows each of the critical performance parameters to be optimized and controlled to suit the hull configuration to which it is applied. This air induction technique was developed because of the obvious advantages and disadvantages of current surfacing propeller drive systems. It was observed that the characteristics of surfacing propellers and the engines used to drive them suffered compatibility problems in their current applications. This observation lead to the need to identify and control critical design elements. The design of surfacing propellers, per se, relies upon very refined science; however their incorporation with a particular hull design requires that a degree of intuitive art be applied. The engines must follow the laws of thermodynamics and be operated in a cost effective manner; thus their operating characteristics are considered a given. In order to make the technologies compatible, it is critical that the interrelationship of their operational parameters be understood. The prior art either completely fails to address the control of air, or the mechanisms that have been employed are cumbersome and require constant operator intervention. This invention recognizes and discloses the relationship between efficient engine operation and air requirements of surface piercing propellers, and provides a method of application of this technology which results in enhanced operation of both the surfacing propeller and its prime mover.

Previous techniques have merely addressed the requirement for air, but have failed to appreciate either the need to control the amount of air supplied or the criticality of timing to the air supply/propeller relationship. The application of the parameters described herein provides the propeller with the environment required by a surfacing propeller. Engine characteristics can be compensated for by using these propeller to air relationships to assist the engine in attaining its torque and rpm design targets. The uniqueness of this invention is that it requires no moving parts, controls or operator intervention. The ability to vary the amount and timing of air to the propeller is achieved by the shape and location of the air induction system, in combination with the nature of water flow and the natural angle change that a marine vessel goes through as it transitions from static to on plane speeds. These features are molded in surfaces of the hull and can be designed to expand the operating window of the vessels it is applied to. The operational characteristics that are gained are 1) effective reverse with directional control, 2) seamless transition from idle to planing speed, 3) stable speed at any sea state and throttle setting.

The propeller enclosing tunnel is defined by a series of surfaces, each of which provide an enhancement to the operation of the vessel. In particular, the top of the tunnel is formed from a flat surface which is used for mounting the propeller strut and rudder. The flat surface also eliminates the need for left and right strut fittings and provides a uniform surface for determination of propeller blade clearance.

A second surface is formed angular to the first surface and positioned perpendicular thereto. The second surface enhances reverse thrust by deflecting prop wash and reducing the "damming" effect typical of a flat transom vessel. A third surface is in juxtaposition to the first surface and provides an angular wall at a right angle, shaped to shield the propeller from obtaining water during high speed acceleration. The aforementioned surfaces create an outer wall for the air tunnel used for transferring air from the transom to a position before the propeller. The angular wall of the tunnel includes a shaped opening that operates as a controlled air passageway to control the air in relation to water flow. This is shaped so as not to foul the air passageway during acceleration, low speed and/or rough sea conditions. However, as the boat accelerates the shaped passageway allows additional air to be transferred to the front face of the propeller. The tunnel and passageway is sized to the particular engine and hull characteristics so as to allow the engines to reach the optimum power curve for acceleration.

Thus, it is an objective of the instant invention to optimize the performance of surface piercing propellers placed beneath a boat.

Yet another objective of the instant invention is to teach a particularly shaped enclosure which functions to control the timing and volume of air flow, in relation to the water flow, throughout the performance curve of the engine and to accommodate inept conditions during low speed operation, acceleration and/or rough sea conditions.

A still further objective of the instant invention is to provide a flat surface for mounting of the struts and rudder so as to eliminate the need for left or right version components.

Yet an additional objective of the instant invention is to provide a surface piercing propeller driven vessel having enhanced reverse thrust characteristics.

Still an additional objective of the instant invention is to correlate the design parameters of the shaped passageway in relation to engine and hull design to optimize boat performance by allowing the engine and hull to operate at optimum design characteristics.

DETAILED DESCRIPTION OF THE PREFERRED EMBODIMENT

Figure 1:
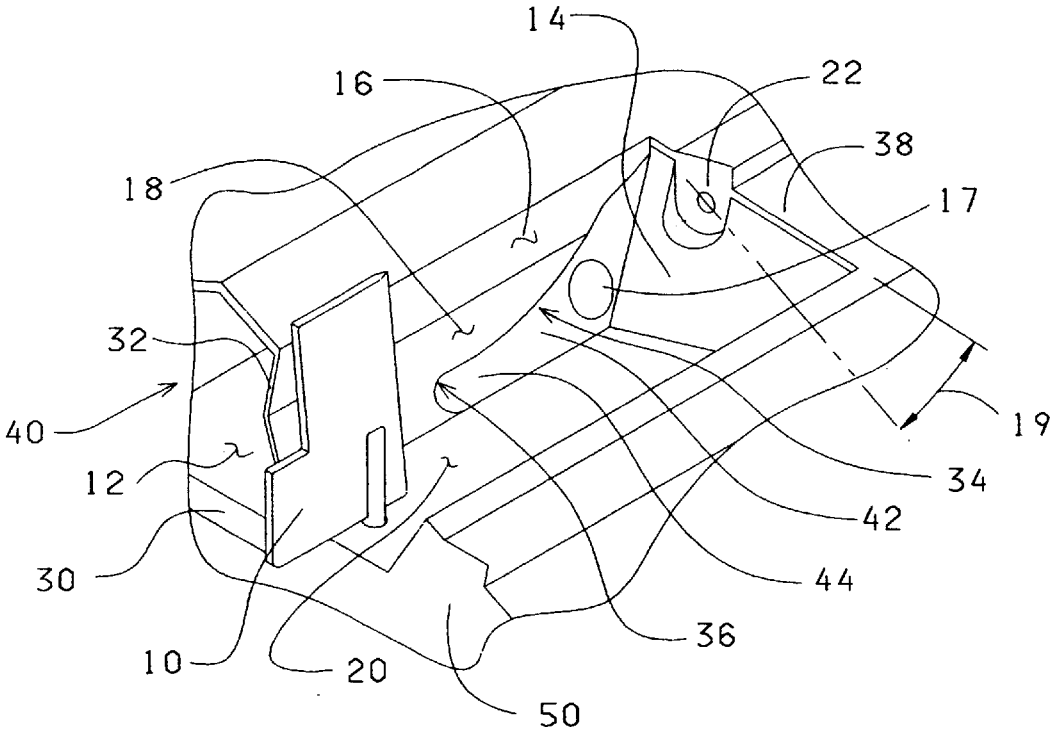
FIG. 1 is a close up of one side of FIG. 2 with the propeller removed for clarity.
Figure 2:
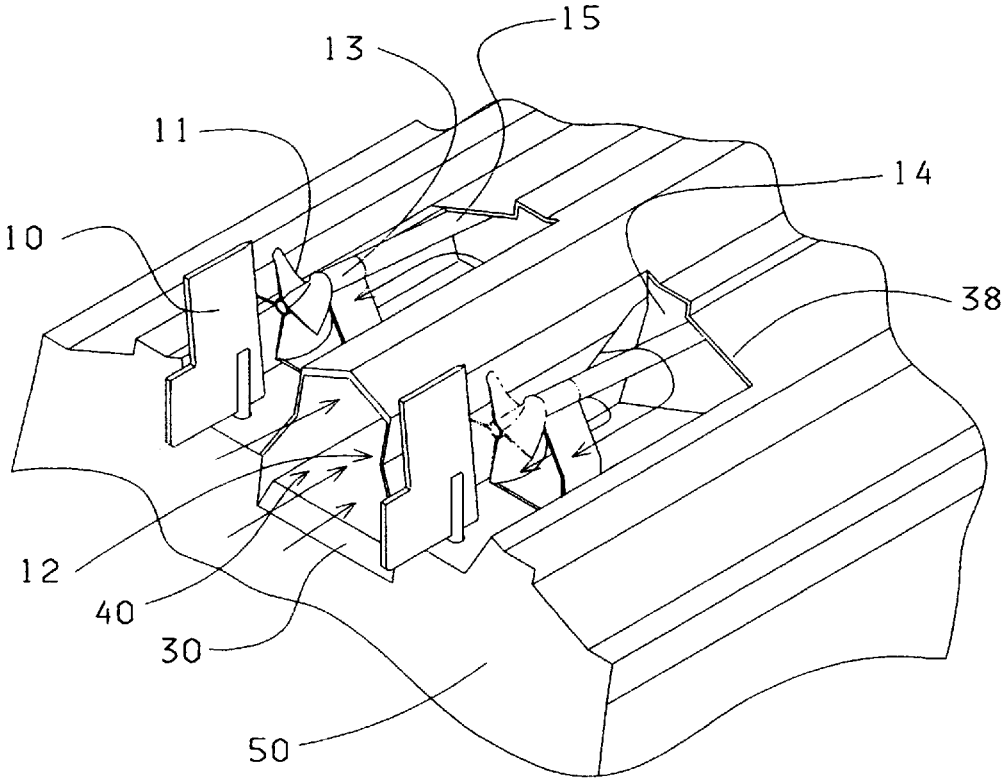
FIG. 2 is an upside down isometric view of the rear portion of a boat having twin surfacing propellers and tunnels.
Figure 6:
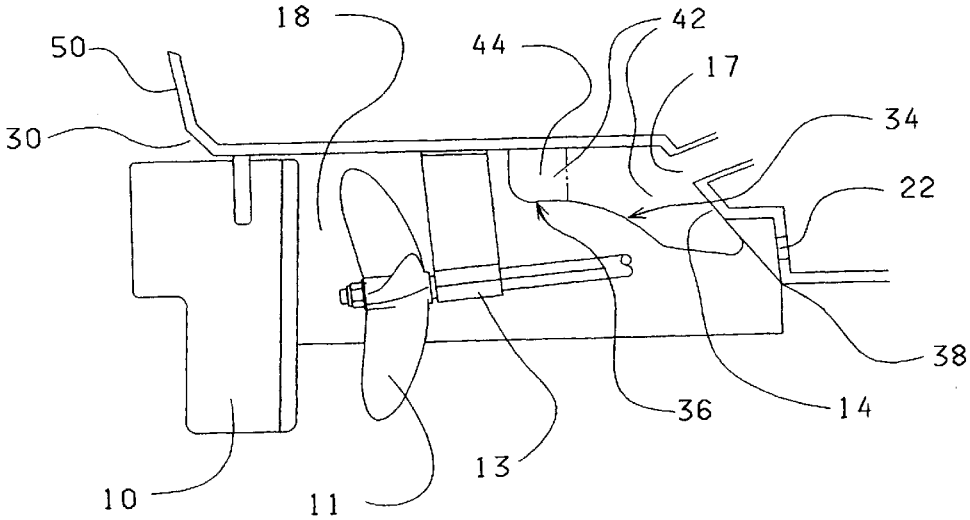
FIG. 6 is a rear section view of the stern portion of a boat having a surfacing propeller in a semi-enclosed tunnel.
Figure 7:
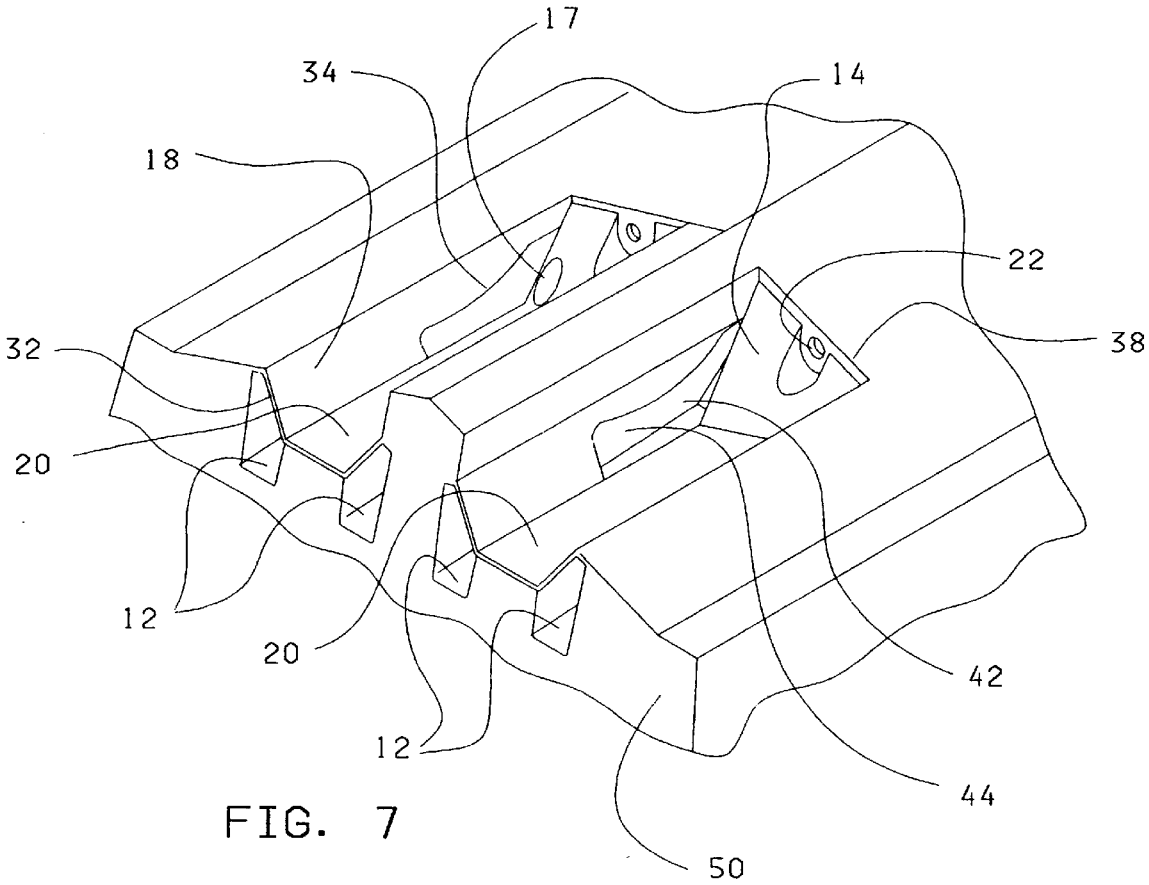
FIG. 7 is a rear section view of the stern portion of a boat having a twin surfacing propellers in a semi-enclosed tunnel with all running gear removed.

Referring now to FIG. 1, an expanded partial view of the hull structure underside 8 inclusive of rudder 10 is shown. This area of the hull contains several surfaces 12,14,16,18, 20 and 22 which have been constructed and arranged so as to act in concert to yield optimum performance and handling characteristics to the vessel in all phases of operation. In contrast to prior art attempts, the surfaces of the instant invention provide abrupt transitions and sharply angled surfaces. This design provides enhanced operation and facilitates construction and manufacturing. Surface 12 defines the roof of the plenum area. Many installations allow this surface to be above the static water line. This surface can also be angled up from its starting point, intersection with surface 14, so as to provide easy escape of exhaust gases during conditions of full vessel load while the vessel is at rest. The angle is typically 1 to 2 degrees up from the static trim angle of the craft, however it is contemplated that this angle will be optimized in relation to the particular vessel. Surface 14 is designed to enhance reverse thrust by deflecting the propeller wash and thereby reducing the damming effect of the transom. This surface may be inclined along two angles. As best seen in FIG. 6, the first inclination, that of the top of surface 14 toward the aft or rear of the vessel, encourages reverse prop wash to continue past the cutwater 38. Referring again to FIG. 1, it can be seen that the defined angle 19, which is skewed from a plane parallel to transom 50, will divert the rearward propwash in a manner that will encourage reverse and side maneuvering. Surfaces 16 and 18 have a two-fold purpose. Firstly, they define the vent wall that provides air to the propeller. Secondly, they act as a shield to limit the amount of water which reaches the propeller during acceleration and high speed operation. Surface 20 provides a flat surface which is parallel to the keel of the craft. This surface provides a consistent surface in the hull, independent of the number of drive systems, on which to mount a universal strut assembly 13 for support of the drive shaft. This approach allows economy of scale in its use of a common strut assembly for all installations of a particular class. Surface 22 provides a flat stable surface perpendicular to the shaft angle, which is convenient for mounting the shaft seal assembly of choice (not shown).

Further referring to FIGS. 1,2,6 and 7, several design features cooperate with the surface geometry so as to provide enhanced operating characteristics. Feature 30 enhances early air entry and exhaust percolation, although in many instances exhaust percolation is avoided by placing the surface 32 above the static water line. Feature 32 is judiciously placed so as to optimize the volume and timing of air entry to open area 40. Area 40 is the entry to the main plenum (plenums) and is sized in accordance with such features as hull weight, horsepower and target speed. This overall open area can be predicted by the following formula:

$$\text{Area 40 (per propeller)}=((\text{Area 11}\times 0.5)+\text{Area 54})\times 0.9$$

where area 11 equals the surface area of the propeller and area 54 is the area between the propeller and the vent walls. This design feature must be judiciously positioned so as to prohibit propwash from reducing the timing and volume to open area 40 while simultaneously permitting enhanced high speed turning and reverse thrust.

Referring to FIG. 6, feature 34 is critical to controlling the flow of water as it passes this region. Appropriate positioning of this feature will insure cooperation with open area 42 so as to prevent water fouling of the inlet air stream moving there through. Area 42 provides the primary air supply to the propeller and is sized so as to allow attainment of maximum speed while preventing fouling by passing water. This over all open area can be predicted by the formula:

$$\text{Area 42}=\text{Area 40}$$

Feature 36 provides a control area for early air induction into area 44, which is approximately 15% of area 42. This is sized so as to allow the propeller to reduce loading while the engine achieves its usable torque and rpm range. Judicious placement of this feature prevents water from fouling vent area 42 while at the same time limiting over ventilation. Feature 38 defines the cutwater. The placement of this feature is dictated by the hull design and represents the point at which the water detaches from the hull during high speed operation. Determining this feature is necessary in order to properly control propeller immersion.

Figure 3:
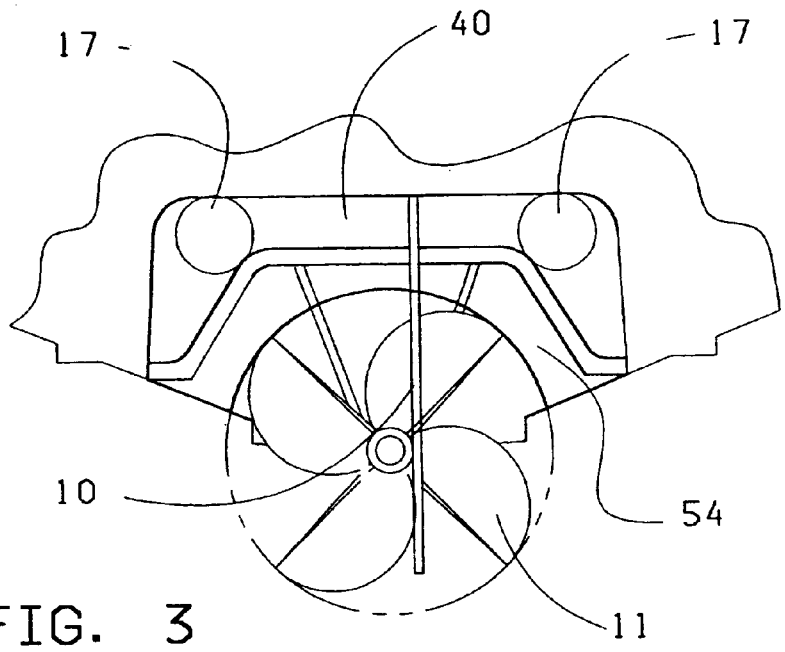
FIG. 3 is a stern view showing a common venting approach for a single propeller boat having a surfacing propeller semi-enclosed in a tunnel.
Figure 4:
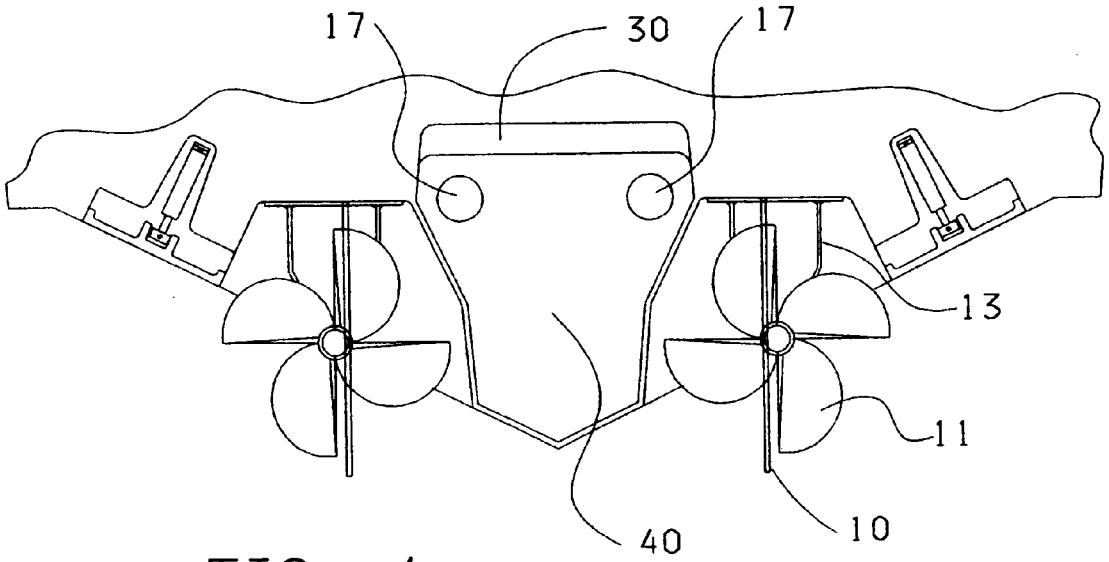
FIG. 4 is a stern view showing a common approach for twin propeller boats having a surfacing propeller semi-enclosed in a tunnel.
Figure 5:
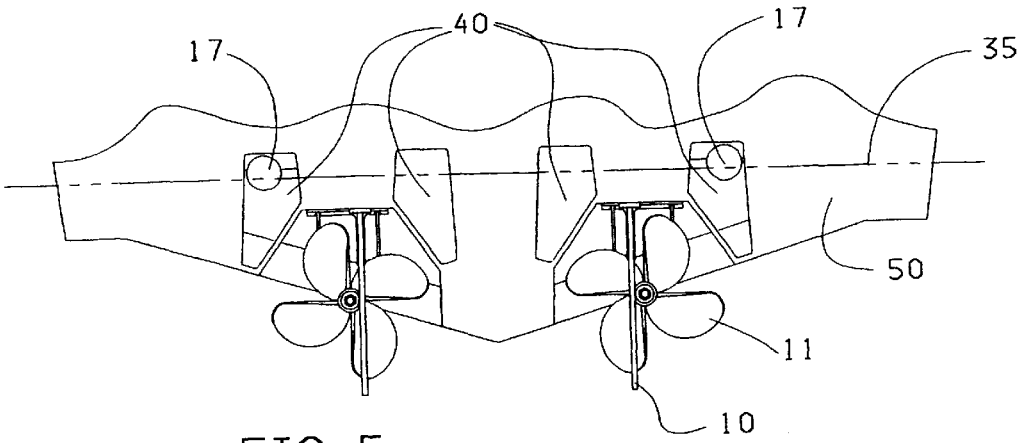
FIG. 5 is a stern view showing a common approach for twin propeller boats having a surfacing propeller semi-enclosed in a tunnel.

Referring to FIG. 3 a rear view of the transom 50 is shown. The area 54 is the area between the propeller and the vent walls. This must be keep to a minimum to insure optimum performance and limit the required size for area 40 and 44. The size of area 40 and 44 is a direct function of area 54 and will increase as area 54 increases. Location 17 is the exhaust outlet for the prime mover. This location is specific in that it is positioned in such a manner that the exhaust has free access to ambient air via plenum (plenums) 40 in static condition yet the forward action of the craft movement will draw the exhaust through area 42 and entrain the smoke and smell of the exhaust with the propwash.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

What is claimed is:

1. In a marine vessel having a particular hull configuration including a transom and at least one engine driven surface piercing propeller positioned within a propeller tunnel formed integral with the hull of the vessel, an improvement comprising:

an air induction system positioned contiguously within said propeller tunnel, said system being operative to control the timing and volume of air flow, as a function of water flow, throughout the engine's performance curve, and including a first flat uppermost surface, a second surface formed in angular relationship to said first surface and providing reverse thrust functionality, said second surface being inclined alone two angles, characterized as a first angle which inclines the surface toward the rear of the vessel and encourages propeller wash to continue past the point at which water detaches from the hull during high speed operation and a second angle which is skewed from a plane parallel to the vessel's transom for diverting the rearward propeller wash for enhanced reverse and side maneuvering, and a third angular wall surface in juxtaposition to the first surface and angularly disposed thereto to prevent the propeller from obtaining water during high speed operation, said third wall including a controlled air passageway having a particularly shaped opening to control passage of air as a function of water flow, said air passageway providing supplemental air to the front face of the propeller during both acceleration and high speed operation and further preventing the propeller from fouling with water during low speed operation, acceleration and rough sea conditions;

wherein optimum engine torque and optimum engine rpm characteristics are maintained throughout the engine's performance curve.

2. The marine vessel in accordance with claim 1, wherein said first surface is angled upward from 1 to 2 degrees above said vessel's static trim angle for facilitating escape of exhaust gases during conditions of full vessel load while the vessel is at rest.

3. The marine vessel in accordance with claim 1, further including a propeller shaft and having a surface which is perpendicular to said vessel's shaft angle, thereby providing a stable mounting surface.

4. The marine vessel in accordance with claim 1, further including at least one plenum opening to provide free access to ambient air during static conditions.

5. The marine vessel in accordance with claim 4, further including an angular surface between said plenum opening and said first surface for enhanced early air entry and exhaust percolation.

6. The marine vessel in accordance with claim 5 wherein said plenum opening has an area equal to 90 percent of the sum of 1) the area between the propeller and vent walls; and 2) one half of the propeller surface area.

7. In a marine vessel having a particular hull configuration including a transom and at least one engine driven surface piercing propeller positioned within a propeller tunnel formed integral with the hull of the vessel, an improvement comprising:

an air induction system positioned contiguously within said propeller tunnel including a first flat uppermost surface, a second surface formed in angular relationship to said first surface characterized as a first angle which inclines the surface toward the rear of the vessel and a second angle skewed from a plane parallel to the vessel's transom and a third angular wall surface in juxtaposition to the first surface and angularly disposed thereto, said third wall including a controlled air passageway having a shaped opening to control passage of air as a function of water flow;

wherein optimum engine torque and rpm characteristics are maintained throughout the engine's performance curve.

8. The marine vessel in accordance with claim 7, wherein said first surface is angled upward from 1 to 2 degrees above said vessel's static trim angle for facilitating escape of exhaust gases during conditions of full vessel load while the vessel is at rest.

9. The marine vessel in accordance with claim 7, further including a propeller shaft and having a surface which is perpendicular to said vessel's shaft angle, thereby providing a stable mounting surface.

10. The marine vessel in accordance with claim 7, further including at least one plenum opening to provide free access to ambient air during static conditions.

11. The marine vessel in accordance with claim 10, further including an angular surface between said plenum opening and said first surface for enhanced early air entry and exhaust percolation.

12. The marine vessel in accordance with claim 10 wherein said plenum opening has an area equal to 90 percent of the sum of 1) the area between the propeller and vent walls; and 2) one half of the propeller surface area.

* * * * *